US009657733B2

(12) United States Patent
Chadwick et al.

(10) Patent No.: US 9,657,733 B2
(45) Date of Patent: May 23, 2017

(54) COMPRESSOR FOR A VEHICLE AIR SUPPLY SYSTEM

(71) Applicant: WABCO Compressor Manufacturing Co., Charleston, SC (US)

(72) Inventors: Thomas Chadwick, North Charleston, SC (US); Michael Klatt, Wadmalaw Island, SC (US); Ramesh Pai, Charleston, SC (US); Steven Wolverton, Hanahan, SC (US)

(73) Assignee: WABCO Compressor Manufacturing Co., Charleston, SC (US)

( * ) Notice: Subject to any disclaimer, the term of this patent is extended or adjusted under 35 U.S.C. 154(b) by 729 days.

(21) Appl. No.: 14/107,599

(22) Filed: Dec. 16, 2013

(65) Prior Publication Data

US 2015/0167663 A1 Jun. 18, 2015

(51) Int. Cl.

| | |
|---|---|
| ***F04B 53/08*** | (2006.01) |
| ***F04B 39/06*** | (2006.01) |
| ***F04B 39/12*** | (2006.01) |

(52) U.S. Cl.

CPC ..... *F04B 53/08* (2013.01); *F04B 39/06* (2013.01); *F04B 39/064* (2013.01); *F04B 39/125* (2013.01)

(58) Field of Classification Search

CPC ..... F04B 39/06; F04B 39/064; F04B 39/122; F04B 39/125; F04B 53/08

(Continued)

(56) References Cited

U.S. PATENT DOCUMENTS 2,514,894 A * 7/1950 Naab ..... F02C 7/275 165/161
4,253,315 A * 3/1981 Fiedler ..... B01D 53/265 165/176

(Continued)

FOREIGN PATENT DOCUMENTS

DE 19535079 A1 4/1996
DE 102010051376 A1 5/2012

(Continued)

OTHER PUBLICATIONS

International Search Report and Written Opinion of PCT/IB2014/002749 dated Dec. 16, 2013.

*Primary Examiner* — Kevin Murphy
*Assistant Examiner* — Jonathan Waddy
(74) *Attorney, Agent, or Firm* — Warner Norcross & Judd LLP

(57) ABSTRACT

A compressor for a vehicle air supply system includes a manifold, a cover, a gasket, an inlet, and an outlet. The manifold and cover are fixedly stacked together, and define a fluid channel system between them. The gasket extends laterally from between the manifold and cover. The fluid channel system includes an inlet air passage extending from the inlet to a cylinder inlet, a discharge air passage extending from a cylinder outlet to the outlet for discharging compressed air to the outlet, and one or more coolant channels that can be fed with a coolant to cool at least the discharge air passage. The inlet air passage, the discharge air passage, and the coolant channel(s) extend laterally, defined by wall faces of the discharge air passage. The wall faces comprise turbulator fins protruding into the discharge air passage. The turbulator fins create turbulence in the discharged compressed air flow.

14 Claims, 4 Drawing Sheets

(58) Field of Classification Search
USPC ..... 137/334, 338, 351, 899; 251/127; 417/313
See application file for complete search history.

(56) References Cited

U.S. PATENT DOCUMENTS 4,761,947 A * 8/1988 Hennecke ..... F02C 7/12 415/115
4,934,667 A * 6/1990 Pees ..... B60G 11/64 188/322.17
5,522,448 A * 6/1996 Righi ..... B22D 17/2218 164/122
5,578,280 A * 11/1996 Kazi ..... B01J 19/088 422/186.07
5,752,801 A * 5/1998 Kennedy ..... F01D 5/187 415/115
5,775,885 A 7/1998 Dreiman et al.
5,860,800 A * 1/1999 Kramer ..... F04B 39/06 165/185
6,116,874 A * 9/2000 Nation ..... F04B 39/064 137/512
6,231,321 B1 * 5/2001 Fukudome ..... F04B 49/035 137/624.11
6,568,920 B2 5/2003 Yttri et al.
8,246,330 B2 * 8/2012 Ay ..... F04B 39/12 417/313
2001/0047718 A1 12/2001 Murdoch
2005/0252225 A1 11/2005 Vetter
2005/0257756 A1 * 11/2005 Endoh ..... F01P 3/02 123/41.79
2011/0070101 A1 * 3/2011 Mezza ..... F04B 39/06 417/53
2013/0228315 A1 * 9/2013 Kennedy ..... H01L 23/473 165/109.1
2016/0053891 A1 * 2/2016 Yeats ..... F04B 39/125 92/143

FOREIGN PATENT DOCUMENTS

EP 1 288 499 A2 3/2003
GB EP 0240278 A2 * 10/1987 ..... F04B 49/24
WO 2009092530 A2 7/2009

* cited by examiner

COMPRESSOR FOR A VEHICLE AIR SUPPLY SYSTEM

FIELD OF THE INVENTION

The present invention generally relates to an improved compressor for an air supply system of a vehicle, such as, for example, a utility vehicle.

BACKGROUND OF THE INVENTION

Vehicle air supply systems are provided for supplying compressed air to pneumatic systems such as pneumatic brakes, pneumatic suspension systems and pneumatic assistance devices in the vehicle. A compressor of a vehicle air supply system generally comprises a compressor block (cylinder block) with an air channel system and a cylinder piston unit. The air channel system provides an inlet air passage, a discharge air passage, at least one coolant channel, and, preferably, a cylinder bore.

Air is sucked through an inlet, for example an inlet flange and the inlet air passage, to a cylinder inlet of the cylinder piston unit in which the air is compressed. The compressed air is then delivered from a cylinder outlet through the discharge air passage to an outlet, for example an outlet flange. The compressed air can then be delivered to a dryer unit for filtering and drying.

Compressors used in vehicles often comprise active cooling systems having coolant channels that can be supplied with a coolant liquid, such as water, in order to cool the compressed air, since the temperature of the air is increased during the compression process. This temperature increase results in an increase in the total temperature of all compressor components and can reduce compressor lifespan.

The cylinder block housing the cylinder piston unit is therefore designed with an eye toward improving heat transfer from the discharge air passage to the coolant channel. The discharge air passage and the coolant channel are located near each other and separated by a wall. One option to improve heat transfer is to guide the discharge air passage and the coolant channel over a long distance and close to each other, thereby enlarging the wall area between these channels. However, the length of the discharge air passage is limited by design constraints, and the flow resistance increases with a smaller cross-sectional area of the discharge air passage. Thus, heat transfer is limited.

To improve heat transfer, it is known to enlarge the surface area of the discharge area. This can be accomplished by providing the long discharge passage or by providing a structure in the surface of the walls of the wide first area of the discharge passage. This structure can comprise protrusions extending into the first area. However, with such constructions, cooling efficiency is limited, and cooling the cylinder block remains a problem.

Further compressor systems are used in cooling devices to compress a refrigerant gas and to deliver the compressed gas—see, e.g., U.S. Pat. Nos. 5,775,885 and 6,568,920. EP 1 288 499 A2 describes another known compressor system.

SUMMARY OF THE INVENTION

Generally speaking, it is an object of the present invention to provide an improved compressor for a vehicle air supply system that enables high efficiency cooling of the compressed air discharged by the compressor.

According to an embodiment of the present invention, the compressor includes a manifold, a cover, a gasket, an inlet and an outlet. The manifold and the cover are fixed to each other in vertically stacked orientation, and define a fluid channel system between them. The gasket extends laterally from between the manifold and the cover, substantially perpendicularly to vertical. The fluid channel system includes an inlet air passage extending from the inlet to a cylinder inlet, a discharge air passage extending from a cylinder outlet to the outlet for discharging compressed air to the outlet, and one or more coolant channels that can be fed with a coolant to cool at least the discharge air passage. The inlet air passage, the discharge air passage, and the coolant channel(s) extend laterally, and are defined by wall faces of the discharge air passage. The wall faces comprise turbulator fins protruding into the discharge air passage. The turbulator fins are configured to create turbulence in the discharged compressed air flow.

The inventors have determined that enlarging the wall faces, in particular the wall faces in the coolant channel for the coolant fluid and the wall faces of the wide first and last areas of the discharge air passage, is not particularly relevant for effective heat exchange. However, creating turbulence by the turbulator fins leads to a significant increase in heat transfer. The turbulator fins are therefore relevant for preventing a laminar flow by creating turbulence, and not for enlarging the total face of the walls. This turbulence is particularly important in a relatively small channel area in the middle of the discharge air passage in which the air flow velocity is high. The effect of the turbulator fins may not be very relevant in wider or larger areas of the discharge air passage, which include a first area, a subsequent tapering transition area leading into the channel area, and an enlarging discharge area at the end of the discharge air passage.

According to a preferred embodiment of the present invention, the turbulator fins protrude in the lateral plane, which is substantially parallel to the gasket and substantially perpendicular to the vertical, stacked orientation of the manifold, the gasket and the cover. Thus, the turbulator fins protrude from wall faces running in approximately the vertical direction.

According to another embodiment, the turbulator fins alternate between the two adjacent walls in the lateral plane perpendicular to the vertical direction. Thus, two neighboring turbulator fins of one wall are spaced apart by a fin spacing, and a turbulator fin of the adjacent or opposing wall is disposed between them. This arrangement prevents high air flow resistance, since the air can flow around the turbulator fins. Thus, the turbulator fins are not provided as an obstacle, but to create turbulence in the air flow through the discharge air passage.

According to a further embodiment, the fin height, which is the size of the turbulator fins substantially perpendicular to the wall face, i.e., the extent to which the turbulator fins protrude into the channel cross-section, is in a specific ratio or relation to the passage width, i.e., the distance between the two opposing walls. This ratio is, preferably, in a range between about 20% and 50%, in particular, 25% to 30%.

According to a still further embodiment, the fin spacing, i.e., the distance between two turbulator fins of one wall, is in a specific ratio or relation to the fin height, which is about 5 to 10 times, preferably, about 8 times, the height of the turbulator fins.

According to yet another embodiment, the wall faces of the inlet air passage, discharge air passage, and the coolant channel are smooth outside the turbulator fins.

It should be appreciated that an advantage of the present invention is that the increased turbulence is high, with a low increase in flow resistance. Heat transfer from the air flow to the walls and, hence, to the coolant channel can be significantly increased. Also, by reducing the discharge air temperature, several disadvantages of conventional constructions can be avoided or minimized—e.g., the oil carryover is lower, reducing carbon build-up and reducing warranty costs; and the coolant flow can be reduced, and the lifespan of the compressor increased.

The compressor block can be made of two casted metal parts—the manifold and the cover, separated by the gasket. The discharge air passage is preferably formed in both the manifold and the cover; the turbulator fins can then extend from one part to the other, respectively.

Still other objects and advantages of the present invention will in part be obvious and will in part be apparent from the specification.

The present invention accordingly comprises the features of construction, combination of elements, and arrangement of parts, all as exemplified in the constructions herein set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
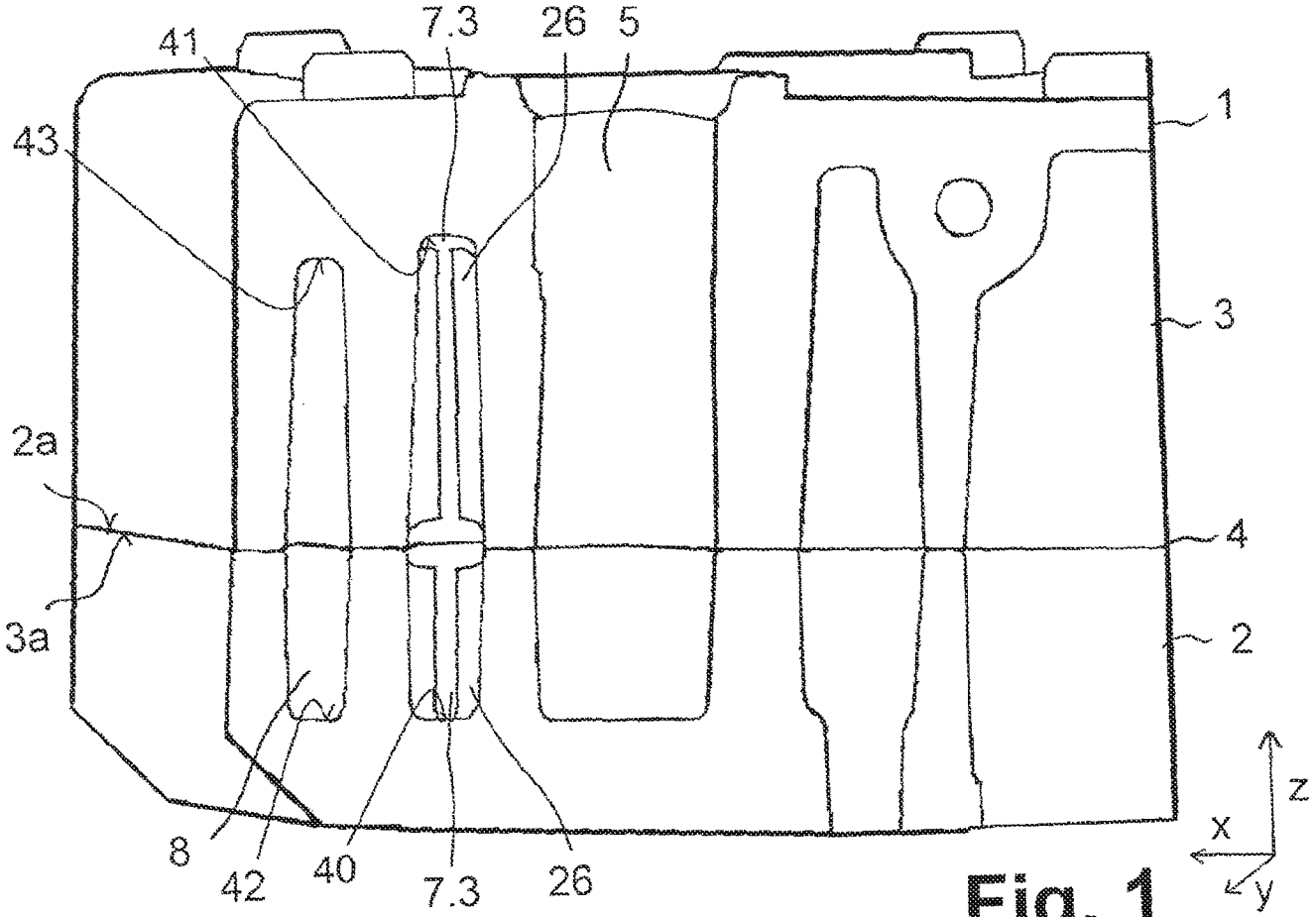
FIG. 1 is a cross-sectional view of a compressor block of a compressor according to an embodiment of the present invention.

FIG. 1 shows, in cross-section, a compressor 1 comprising a manifold 2, a cover 3, and a gasket 4 disposed between the manifold 2 and the cover 3. The manifold 2 and the cover 3 are formed from metal, e.g., by a die casting process, and form a compressor block with several passages and at least one cylinder bore 5 for accommodating a piston.

The cylinder bore 5, an inlet air passage 6, a discharge air passage 7, and at least one coolant channel 8 are formed in both the manifold 2 and the cover 3. An exemplary layout of the cylinder bore 5, the inlet air passage 6, the discharge air passage 7, and the coolant channel 8 is shown in the top view of the manifold 2 depicted in FIG. 2. The gasket 4 serves to seal the cylinder bore 5 and the passages 6, 7 with respect to each other.

Referring back to FIG. 1, the manifold 2 and the cover 3 are shown stacked together in vertical direction Z with the gasket 4 between them in order to seal the channel system described herein. Thus, the horizontal plane extends laterally with respect to the vertical Z direction. The gasket 4 is between a manifold face 2*a* and a cover face 3*a*, which extend in the lateral plane.

With the inlet air passage 6, the discharge air passage 7, and the coolant channel 8 being completely formed in the manifold 2 and the cover 3, the discharge air passage 7 and the coolant channel 8 are defined in the vertical direction Z by first passage grounds 40, 42 of the cover 3 and second passage grounds 41, 43 of the manifold. Therefore, the inlet air passage 6, the discharge air passage 7, and the coolant channel 8 do not extend in the vertical direction through the manifold 2 or the cover 3.

The inlet air passage 6 is connected to an inlet flange 9. Air is sucked through the inlet flange 9 and the inlet air passage 6 to a cylinder inlet 10*a* of the cylinder piston unit, i.e., into the cylinder bore 5, in which a piston can reciprocate to compress the air. An air flow 16 of hot compressed air is discharged from a cylinder outlet 10*b* through the discharge air passage 7 to an air outlet 12 delivering compressed air to subsequent devices, e.g., to a valve arrangement and an air dryer device supplying compressed air to storage tanks of subsequent pneumatic circuits such as, for example, pneumatic brake circuits. The coolant channel 8 runs between two coolant channel flanges 8.1 and 8.2, and serves to cool this arrangement by removing heat from the hot air flow 16 of compressed air flowing through the discharge air passage 7.

The manifold 2 and the cover 3 can be fixed together—e.g., via bolts inserted into bolt holes 14 extending through both the manifold 2 and the cover 3.

Figure 2:
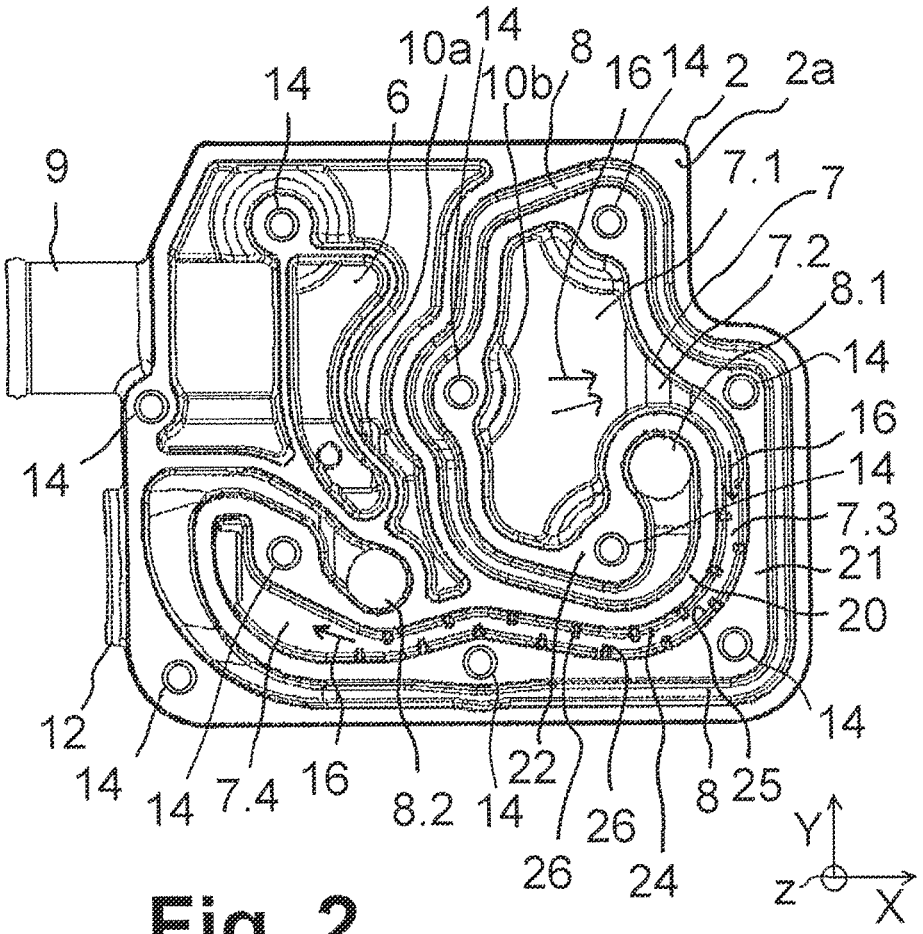
FIG. 2 is a top view of the manifold embodiment depicted in FIG. 1.

FIG. 2 is a top view of the horizontal manifold face 2*a* of the manifold 2, which corresponds to the horizontal plane of the gasket 4. The horizontal cover face 3*a* of the cover 3 is configured to be substantially a mirror image of the manifold face 2*a*. The air passages 6, 7, the coolant channel 8, and the cylinder bore 5 are defined by and separated by walls 20, 21, 22, which are part of the manifold 2. The gasket 4 corresponds to the cross-sectional areas of the walls 20, 21, 22.

The discharge air passage 7 extends from a first area 7.1 having a larger or wider extension, a subsequent tapering transition area 7.2, and a channel area 7.3 of substantially constant cross-section to an outlet area 7.4, which widens from the small cross-section of the channel area 7.3 to the air outlet flange 12. The air flow 16 therefore flows in this direction from the first area 7.1 to the outlet area 7.4. The channel area 7.3 of the discharge air passage 7 is located between the first wall 20 and second wall 21. The channel area 7.3 is therefore defined by a wall face 24 of the first wall 20 and a wall face 25 of the second wall 21, which run substantially parallel; thus, the channel area 7.3 comprises a substantially constant cross-section defined by the channel width, which is the distance between the wall face 24 of the first wall 20 and the wall face 25 of the second wall 21.

The coolant channel 8 is located near the discharge air passage 7 in order to cool it. The coolant channel 8 is separated from the channel area 7.3 by the second wall 21.

Turbulator fins 26 protrude from the wall face 24 and from the wall face 25 and extend into the channel area 7.3. The turbulator fins 26 are desirably provided in only the channel area 7.3 of the discharge air passage 7, and not in the first area 7.1, the transition area 7.2 of tapering cross-section, and the discharge area 7.4 with its enlarging or widening cross-section. The turbulator fins 26 can be arranged in an alternating pattern in which a turbulator fin 26 provided at the wall face 25 protrudes between two neighboring turbulator fins 26 of the wall face 24.

The turbulator fins 26 create turbulence in the air flow 16 inside the channel area 7.3 of the discharge air passage 7—thus, reducing laminar flow. Therefore, the turbulator fins 26 improve heat transfer from the air flow 16 to the wall faces 24 and and into the walls 20 and 21. Ideally, the turbulator fins 26 are provided in the channel area 7.3 where the flow profile of the air flow 16 becomes fully developed, and the placement of the turbulator fins 26 stops before or at the beginning of the discharge area 7.

Figure 4:
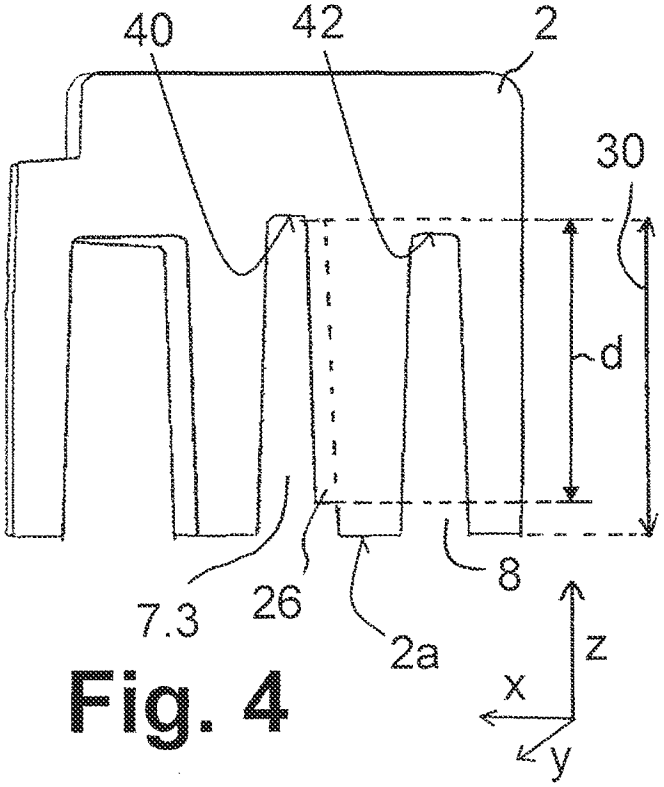
FIG. 4 is a cross-sectional view of the manifold embodiment depicted in FIGS. 1-3.
Figure 3:
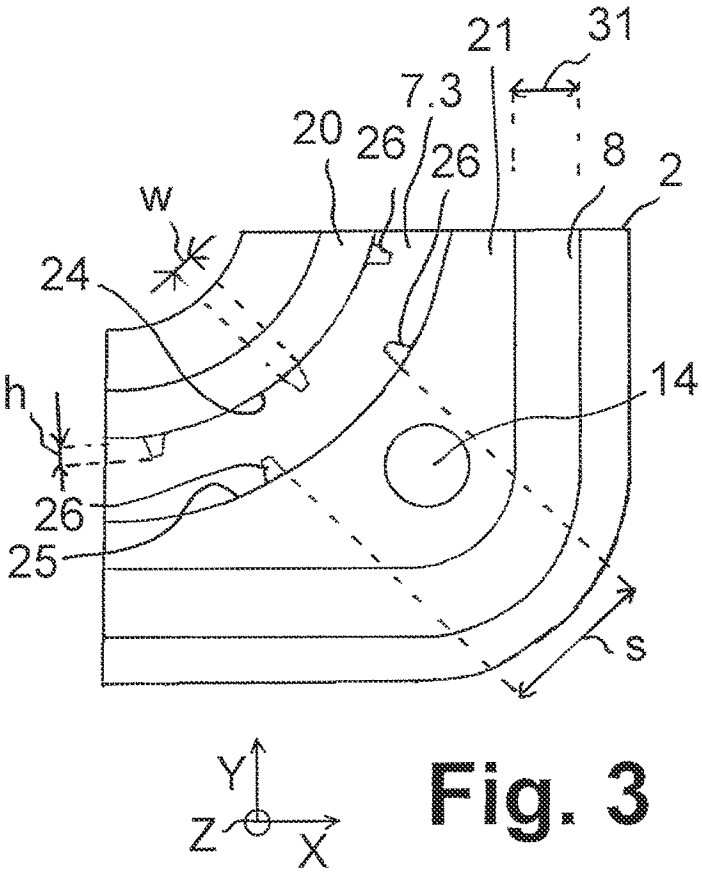
FIG. 3 is an enlarged view of a portion of the manifold of FIG. 2.

The construction and arrangement of the turbulator fins 26 is shown in greater detail in FIGS. 3 and 4. The turbulator fins 26 are defined by their fin width w, fin height h, and fin spacing s, which is the distance between two subsequent or neighboring turbulator fins 26 on one wall face 24 or 25. Maximum mixing of the air flow 16 occurs with the turbulator fins 26 spaced at a fin spacing s that is approximately eight times the fin height h; thus, the ratio of the fin spacing s to the fin height h is preferably in the range of about 8.

$$s=8h \text{ or } s\approx 8h$$

However, a range of a ratio of about 8 to 10 can also yield salutary results.

The fin width w does not affect the amount of turbulence of the air flow 16 in any relevant way.

The turbulator fins 26 may be trapezoid-shaped as shown in FIG. 3; however, other shapes or configurations can be used.

The fin depth d, which is the size or dimension of the turbulator fins 26 in vertical direction Z or stack direction of the manifold 2, gasket 4, and cover 3, may be in the range of about 0.5 to 1 of the depth 30 of the channel area 7.3. The depth 30 can be defined as the distance between the first passage ground 40 of the channel area 7.3 and the manifold face 2*a*.

The turbulator fins 26 are provided for creating or effecting turbulence, and not for enlarging the surface or total surface of the wall faces 24 and 25 of the walls 20 and 21; and, therefore, a fin depth d smaller than the channel depth 30 is not problematic. However, better performance can be expected with a fin depth d equal to or nearly equal to the channel depth 30, so that the turbulator fins 26 can run the full channel depth 30 of the channel area 7.3.

The fin height h is preferably in the range of about 20% to 50% of the channel width 31, in particular, about 25% to 30% of the channel width 31, in order to create optimal turbulence with relatively low resistance to the air flow 16. Thus, in a compressor 1 with a channel area 7.3 comprising a channel width 31 of about 7 mm, for example, optimal fin height h is approximately 2 mm.

As noted above and as shown in FIG. 1, the turbulator fins 26 are provided in both the manifold 2 and the cover 3, which together form the discharge air passage 7. Preferably, no turbulator fins 26 are provided in the inlet air passage 6 and the coolant channel 8.

The turbulator fins 26 can be formed integrally in the manifold 2 and the cover 3. This permits the manifold 2 and the cover 3 to be die-casted.

Figure 5:
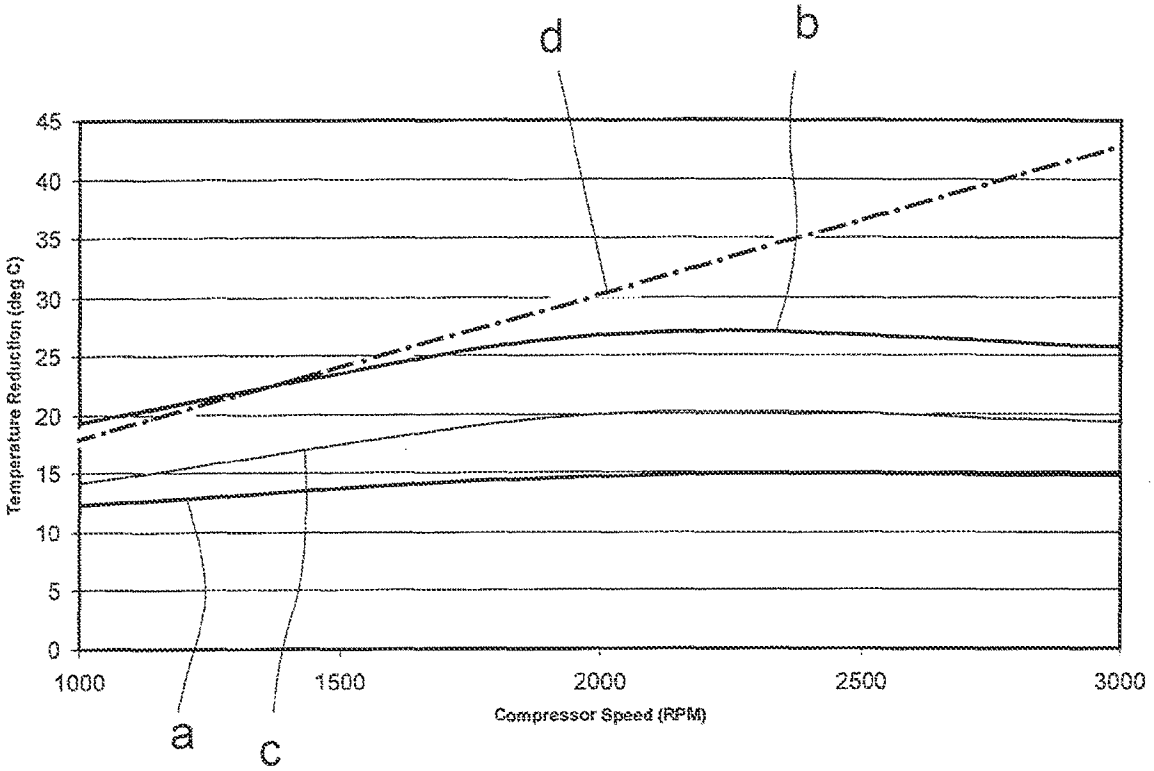
FIG. 5 is a graph illustrating the average temperature reduction of the compressor according to the embodiment of the present invention depicted in FIGS. 1-4 compared against a conventional compressor without turbulator fins.

FIG. 5 graphically illustrates the effect of the turbulator fins 26. FIG. 5 depicts the average temperature reduction of the compressor 1 according to the inventive embodiment depicted in FIGS. 1 to 4 compared against a conventional compressor without turbulator fins. The curves show the temperature reduction in degrees Celsius as a function of the compressor speed in Rotations Per Minute (RPM)—curve (a) for the case of 0 bar boost, curve (b) for a 1 bar boost, and curve (c) for a 3 bar boost.

It will thus be seen that the objects set forth above, among those made apparent from the preceding description, are efficiently attained, and since certain changes may be made without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall there-between.

What is claimed is:

1. A compressor for an air supply unit of a vehicle, the compressor comprising: a manifold; a cover; a gasket between the manifold and the cover; an inlet; and an outlet; the manifold and the cover being fixedly stacked in vertical orientation and defining a fluid channel system therebetween; the gasket extending laterally, substantially perpendicularly to vertical; the fluid channel system comprising an inlet air passage extending from the inlet to a cylinder inlet, a discharge air passage extending from a cylinder outlet to the outlet for discharging compressed air to the outlet, and at least one coolant channel feedable with a coolant to cool at least the discharge air passage; the inlet air passage, the discharge air passage, and the at least one coolant channel extending laterally, the discharge air passage being defined by wall faces including at least one wall face of a wall separating the discharge air passage from the at least one coolant channel; the wall faces comprising turbulator fins protruding into the discharge air passage, the turbulator fins being configured to create turbulence in discharged compressed air; and a cylinder bore formed in the manifold and the cover and connected to the cylinder inlet and the cylinder outlet, the cylinder bore being configured to accommodate a piston to form a cylinder-piston unit for compressing air delivered from the inlet to the cylinder inlet and for delivering compressed air to the cylinder outlet.

2. The compressor according to claim 1, wherein the inlet air passage, the discharge air passage, and the at least one coolant channel are formed in both the manifold and the cover.

3. The compressor according to claim 2, wherein the inlet air passage, the discharge air passage, and the at least one coolant channel are defined in vertical direction by first passage grounds in the manifold and second passage grounds in the cover.

4. The compressor according to claim 1, wherein the manifold and the cover are formed from die-casted metal.

5. The compressor according to claim 1, wherein the inlet and the outlet are formed in at least one of the cover and the manifold, respectively.

6. The compressor according to claim 1, wherein the turbulator fins protrude laterally into the discharge air passage.

7. A compressor for an air supply unit of a vehicle, the compressor comprising: a manifold; a cover; a gasket between the manifold and the cover; an inlet; and an outlet; the manifold and the cover being fixedly stacked in vertical orientation and defining a fluid channel system therebetween; the gasket extending laterally, substantially perpendicularly to vertical; the fluid channel system comprising an inlet air passage extending from the inlet to a cylinder inlet, a discharge air passage extending from a cylinder outlet to the outlet for discharging compressed air to the outlet, and at least one coolant channel feedable with a coolant to cool at least the discharge air passage; the inlet air passage, the discharge air passage, and the at least one coolant channel extending laterally, the discharge air passage being defined by wall faces including at least one wall face of a wall separating the discharge air passage from the at least one coolant channel; the wall faces comprising turbulator fins protruding into the discharge air passage, the turbulator fins being configured to create turbulence in discharged compressed air; wherein the discharge air passage comprises a first area connected to the cylinder outlet, a transition area having a tapering cross-section connected to the first area, a channel area having a substantially constant cross-section connected to the transition area, and an outlet area widening from the channel area and connected to the outlet, and wherein the turbulator fins are arranged only in the channel area.

8. The compressor according to claim 7, wherein the wall faces include first and second wall faces defining the channel area between them, and the turbulator fins are arranged in an alternating pattern on the first and second wall faces such that an individual one of the turbulator fins on the first wall face is disposed between a neighboring pair of the turbulator fins on the second wall face.

9. The compressor according to claim 8, wherein a fin spacing between the neighboring pair of turbulator fins is five to ten times a fin height of the turbulator fins.

10. The compressor according to claim 9, wherein the fin spacing is eight times the fin height.

11. The compressor according to claim 7, wherein the turbulator fins extend into the channel area by a fin height and reduce the cross-section of the channel area, and wherein the fin height is 20% to 50% of a channel width of the channel area.

12. The compressor according to claim 11, wherein the fin height is 25% to 30% of the channel width.

13. The compressor according to claim 11, wherein the turbulator fins have a fin depth 60% to 100% of a channel depth of the channel area.

14. The compressor according to claim 1, wherein the wall faces of the discharge air passage are smooth outside the turbulator fins.

* * * * *